US011203507B1

(12) United States Patent
Taguchi

(10) Patent No.: US 11,203,507 B1
(45) Date of Patent: Dec. 21, 2021

(54) SHEET POST-PROCESSING APPARATUS

(71) Applicant: TOSHIBA TEC KABUSHIKI KAISHA, Tokyo (JP)

(72) Inventor: Hiroyuki Taguchi, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/152,522

(22) Filed: Jan. 19, 2021

(51) Int. Cl.

| | |
|---|---|
| ***B65H 37/06*** | (2006.01) |
| ***B65H 45/16*** | (2006.01) |
| ***B65H 37/04*** | (2006.01) |
| ***B65H 45/18*** | (2006.01) |

(52) U.S. Cl.
CPC ..... *B65H 45/167* (2013.01); *B65H 37/04* (2013.01); *B65H 37/06* (2013.01); *B65H 45/18* (2013.01); *B65H 2301/512* (2013.01); *B65H 2801/27* (2013.01)

(58) Field of Classification Search
CPC ..... B65H 37/04; B65H 37/06; B65H 45/18; B65H 45/167; B65H 2301/512; B65H 2801/27
USPC ..... 270/37; 493/422, 424, 434, 435, 444, 493/445
See application file for complete search history.

(56) References Cited

U.S. PATENT DOCUMENTS

| | | | | |
|---|---|---|---|---|
| 5,020,785 | A * | 6/1991 | Kosaka | B42B 4/00 270/58.11 |
| 6,006,065 | A * | 12/1999 | Seki | B65H 45/14 270/37 |
| 6,712,349 | B2 * | 3/2004 | Watanabe | B65H 15/00 270/37 |
| 6,730,010 | B2 * | 5/2004 | Yamakawa | B65H 45/12 493/267 |
| 7,871,065 | B2 * | 1/2011 | Fukasawa | B65H 45/18 270/37 |
| 8,529,423 | B2 * | 9/2013 | Imazu | B65H 45/142 493/434 |
| 9,302,880 | B2 * | 4/2016 | Awano | B65H 5/062 |
| 2002/0033569 | A1 | 3/2002 | Watanabe | |

FOREIGN PATENT DOCUMENTS

JP 2012-197138 A 10/2012

* cited by examiner

*Primary Examiner* — Leslie A Nicholson, III
(74) *Attorney, Agent, or Firm* — Foley & Lardner LLP

(57) ABSTRACT

A sheet post-processing apparatus includes a stacker, a pair of folding rollers having a nip portion therebetween, and a blade. A sheet is stacked on the stacker. The blade is configured to fold the sheet in half by pushing the sheet stacked on the stacker into the nip portion of the pair of folding rollers. The pair of folding rollers are configured to switch between a first posture and a second posture. In the first posture, the sheet is pushed into the nip portion by the blade. In the second posture, a feeding direction of the sheet is different from that in the first posture.

20 Claims, 9 Drawing Sheets

SHEET POST-PROCESSING APPARATUS

FIELD

Embodiments described herein relate generally to a sheet post-processing apparatus.

BACKGROUND

The sheet post-processing apparatus performs post-processing on a sheet conveyed from an image forming apparatus (e.g., a multifunctional peripheral (MFP)). For example, the sheet post-processing apparatus includes a processing unit that performs stapling or the like on the sheet. The sheet post-processing apparatus may further include a folding mechanism for bundling a plurality of sheets and folding the sheets in half. The folding mechanism includes a stacker, a pair of folding rollers, and a blade. The blade folds the sheets in half by pushing the sheets stacked on the stacker into a nip portion of the folding roller.

The sheet that passed through the folding roller is discharged to a sheet discharge tray. Considering stackability of the sheet on the sheet discharge tray, the orientation of the sheet when the sheet is sent to the sheet discharge tray is desirably downward rather than horizontal.

Depending on a type of processing unit, the stacker may need to be inclined toward the blade in the vertical direction. In that case, a feeding direction of the sheet by the folding roller is obliquely upward. In order to change an advancing direction of the sheet obliquely downward, the sheet post-processing apparatus may be provided with a structure that abuts on the sheet to change the direction of the sheet. A dedicated conveyance roller may be provided to change the direction of the sheet.

However, if an abutting structure for changing the direction is used, when the sheet is brought into abutment on the abutting structure, the surface of the sheet may be rubbed and damaged. When the dedicated conveyance roller is used, the configuration becomes complicated and miniaturization of an apparatus may be difficult.

DETAILED DESCRIPTION

In general, according to one embodiment, there is provided a sheet post-processing apparatus including a stacker, a pair of folding rollers, and a blade. A sheet is stacked on the stacker. The blade is configured to fold the sheet in half by pushing the sheet stacked on the stacker into a nip portion of the folding rollers. The folding rollers are configured to be able to switch between a first posture and a second posture. In the first posture, the sheet is pushed into the nip portion by the blade. In the second posture, a feeding direction of the sheet is different from that in the first posture.

Hereinafter, a sheet post-processing apparatus of an embodiment will be described with reference to the drawings.

Figure 1:
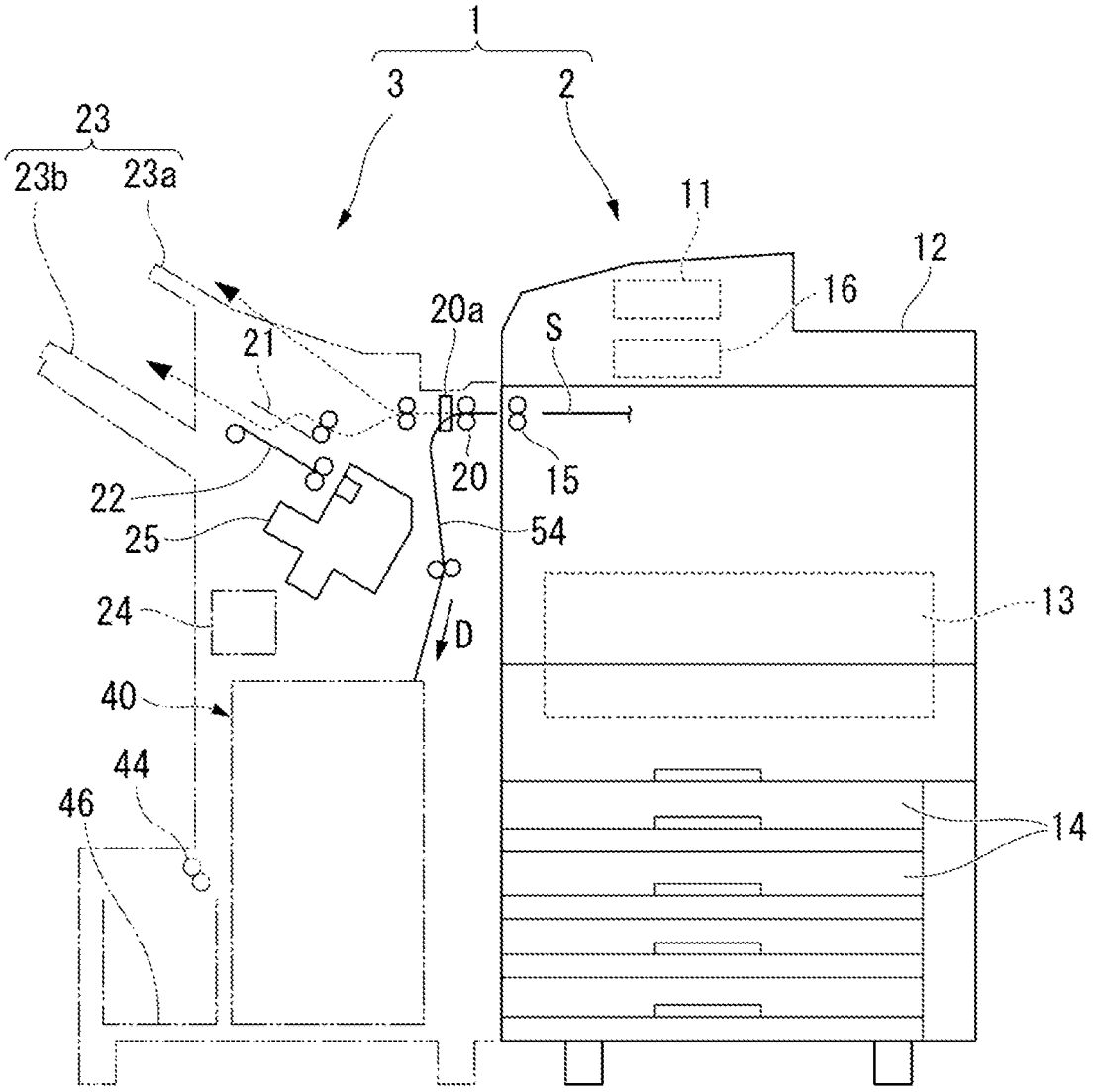
FIG. 1 is a diagram illustrating an example of an image forming system of an embodiment.

FIG. 1 is a diagram illustrating an example of an image forming system 1 of the embodiment. As illustrated in FIG. 1, the image forming system 1 includes an image forming apparatus 2 and a sheet post-processing apparatus 3. The sheet post-processing apparatus 3 is simply referred to as "post-processing apparatus 3".

The image forming apparatus 2 forms an image on a sheet-shaped recording medium such as paper. The recording medium is "sheet S". For example, the image forming apparatus 2 is a multi-function peripherals (MFP), a printer, a copying machine, or the like, which is a multifunctional machine. The post-processing apparatus 3 performs post-processing on the sheet S conveyed from the image forming apparatus 2. The sheet S is not limited to paper, but includes a plastic sheet such as an overhead projector (OHP) sheet. The sheet S may be supplied from the image forming apparatus 2 to the post-processing apparatus 3, or may be manually supplied to the post-processing apparatus 3.

Figure 2:
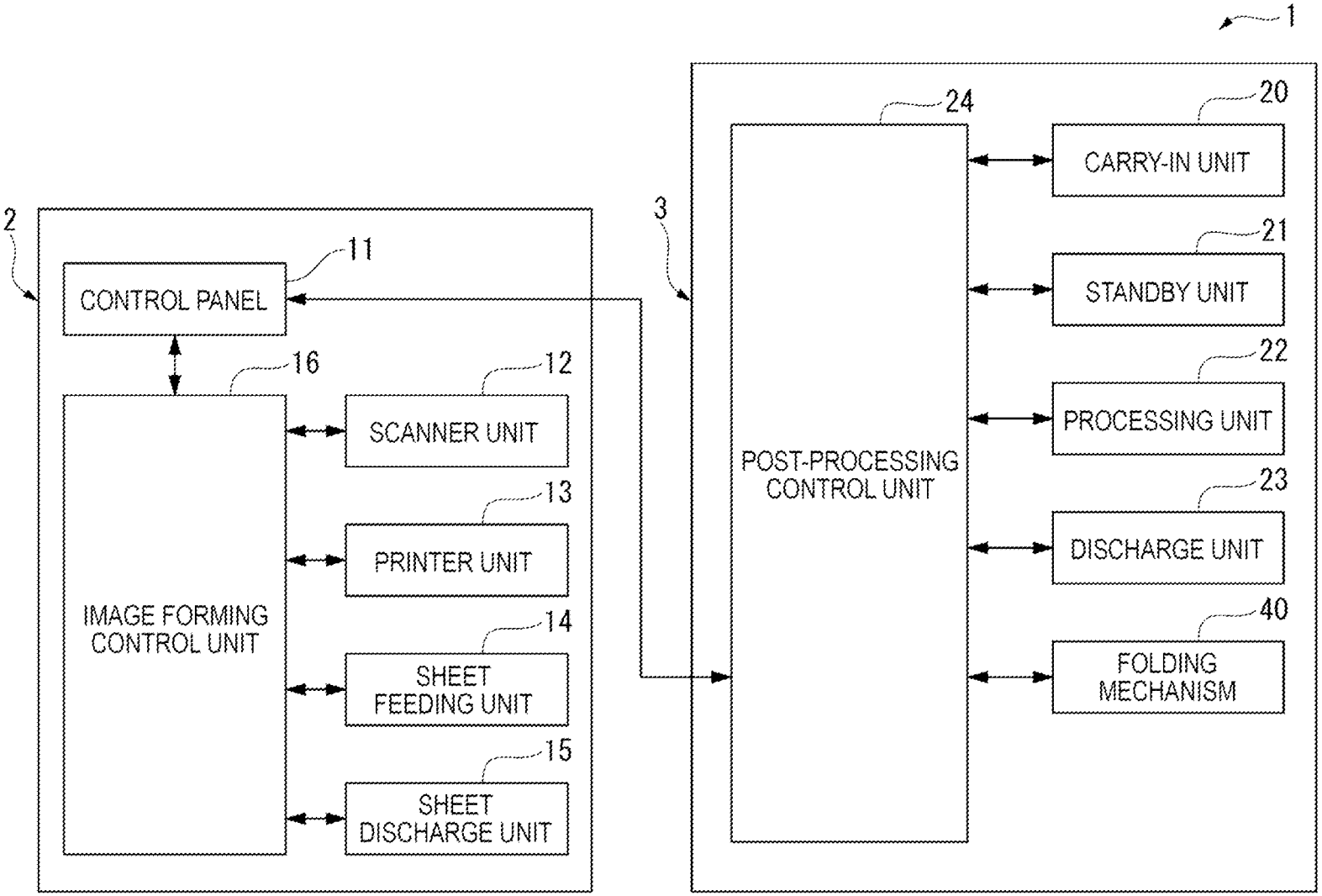
FIG. 2 is a block diagram illustrating a configuration of the image forming system.

FIG. 2 is a block diagram illustrating a configuration of the image forming system 1 of the embodiment. As illustrated in FIG. 2, the image forming apparatus 2 includes a control panel 11, a scanner unit 12, a printer unit 13, a sheet feeding unit 14, a sheet discharge unit 15, and an image forming control unit 16.

The control panel 11 includes various keys or touch panels that receive user operations. For example, the control panel 11 receives an input regarding a type of post-processing of the sheet S. The image forming apparatus 2 sends information regarding the type of post-processing to the post-processing apparatus 3.

The scanner unit 12 includes a reading unit that reads image information of an object to be copied. The scanner unit 12 sends read image information to the printer unit 13. The printer unit 13 forms an output image with a developer such as toner based on the image information transmitted from the scanner unit 12 or an external device. The output image is a "toner image". The printer unit 13 transfers the toner image onto a surface of the sheet S. The printer unit 13 applies heat and pressure to the toner image transferred to the sheet S to fix the toner image on the sheet S.

The sheet feeding unit 14 supplies the sheets S one by one to the printer unit 13 in accordance with the timing when the printer unit 13 forms the toner image. The sheet discharge unit 15 conveys the sheet S discharged from the printer unit 13 to the post-processing apparatus 3.

The image forming control unit 16 controls the overall operation of the image forming apparatus 2. The image forming control unit 16 controls the control panel 11, the scanner unit 12, the printer unit 13, the sheet feeding unit 14, and the sheet discharge unit 15. The image forming control unit 16 includes a control circuit including a central processing unit (CPU), a read only memory (ROM), and a random access memory (RAM).

Next, the post-processing apparatus 3 will be described. As illustrated in FIG. 1, the post-processing apparatus 3 is adjacent to the image forming apparatus 2. The image forming apparatus 2 conveys the sheet S to the post-processing apparatus 3. The post-processing apparatus 3 executes post-processing designated through the control panel 11 on the conveyed sheet S. For example, the post-processing apparatus 3 performs stapling and sorting. For example, the post-processing apparatus 3 performs sheet folding that folds the sheet S in half and discharges the sheet S.

The post-processing apparatus 3 includes a carry-in unit 20, a standby unit 21, a processing unit 22, a discharge unit 23, a post-processing control unit 24 (control unit), a folding mechanism 40, a pair of discharge rollers 44, and a sheet discharge tray 46.

The carry-in unit 20 is continuous with a downstream side of the paper discharge unit 15 in the conveyance direction. The carry-in unit 20 receives the sheet S conveyed from the image forming apparatus 2.

The standby unit 21 temporarily retains the sheet S conveyed from the image forming apparatus 2. The standby unit 21 is located above the processing unit 22. When the processing unit 22 becomes empty, the standby unit 21 drops the retained sheet S toward the processing unit 22.

The processing unit 22 performs post-processing on the conveyed sheet S. For example, the processing unit 22 performs sorting for aligning and arranging a plurality of sheets S. For example, the processing unit 22 performs sheet binding on a sheet bundle in which a plurality of sheets S are aligned with staples or adhesive tape. Reference numeral 25 in the figure indicates a sheet binding device for binding a bundle of sheets in the processing unit 22 with staples or the like. The processing unit 22 discharges the sheet S subjected to post-processing to the discharge unit 23.

The discharge unit 23 includes a fixed tray 23*a* and a movable tray 23*b*. The fixed tray 23*a* is located on the upper part of the post-processing apparatus 3. The movable tray 23*b* is located on the side of the post-processing apparatus 3. The sheet S is discharged to the fixed tray 23*a* and the movable tray 23*b*.

As illustrated in FIG. 2, the post-processing control unit 24 controls the overall operation of the post-processing apparatus 3. That is, the post-processing control unit 24 controls the operations of the carry-in unit 20, the standby unit 21, the processing unit 22, the discharge unit 23, and the folding mechanism 40. Similar to the image forming control unit 16, the post-processing control unit 24 includes a control circuit including a CPU, a ROM, and a RAM.

Figure 3:
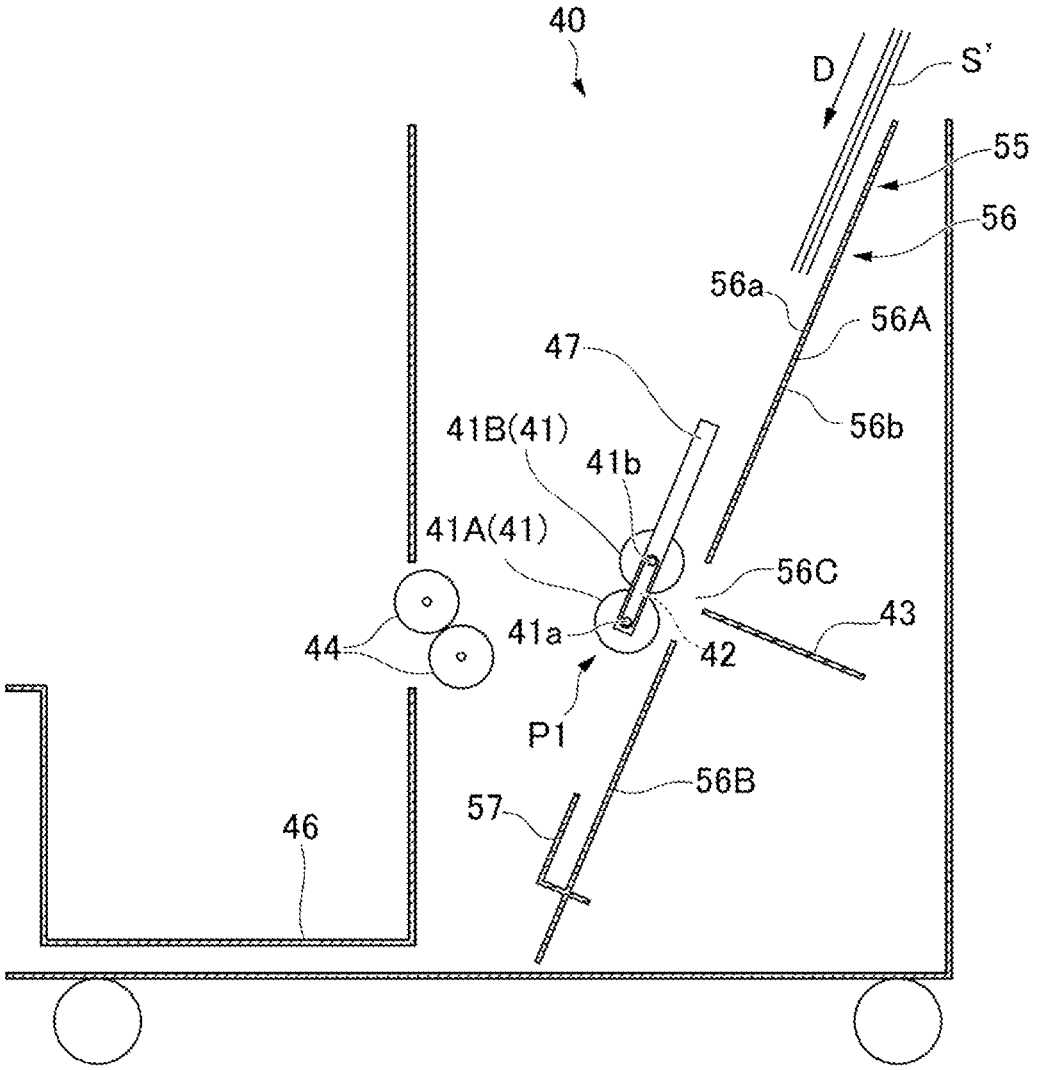
FIG. 3 is a block diagram of an example of a folding mechanism of a sheet post-processing apparatus of an embodiment.

FIG. 3 is a perspective view illustrating an example of the folding mechanism 40 of the embodiment. As illustrated in FIG. 3, the folding mechanism 40 folds one or a plurality of sheets S in half. In this embodiment, a sheet bundle S' composed of the plurality of sheets S is folded in half. For example, the number of sheets S forming the sheet bundle S' can be 2 to 30 sheets. A direction along the conveyance path of the sheet bundle S' supplied to the folding mechanism 40 is a sheet conveyance direction D. The sheet conveyance direction D is also simply referred to as a "conveyance direction". The direction orthogonal to the paper surface of FIG. 3 is a "sheet width direction".

The folding mechanism 40 includes a stacker 55, a pair of folding rollers 41, a plunger or blade 43, and a lever 47. The stacker 55 includes a guide member 56 and a support claw 57 (e.g., a stop, a support, etc.). The guide member 56 has a flat plate shape. A surface of the guide member 56 facing the folding rollers 41 is a stacking surface 56*a*. The stacking surface 56*a* is a surface on which the sheet bundle S' is stacked. The guide member 56 takes an upright posture inclined with respect to the vertical direction (perpendicular direction in FIG. 3). The guide member 56 is inclined so that the stacking surface 56*a* faces obliquely upward. A back surface 56*b* of the guide member 56 is a surface opposite to the stacking surface 56*a*.

The guide member 56 includes a first guide member 56A and a second guide member 56B. A gap 56C is present between the first guide member 56A and the second guide member 56B through which the blade 43 can advance and retreat. The support claw 57 is located on the second guide member 56B. The support claw 57 projects from the stacking surface 56*a*. The support claw 57 supports the lower end of the sheet S stacked on the stacking surface 56*a*. The height position of the support claw 57 can be adjusted along the second guide member 56B.

The pair of folding rollers 41 are located roughly at positions facing the stacking surface 56*a* of the guide member 56. The pair of folding rollers 41 form a nip portion 42. For example, the folding rollers 41 are rubber rollers. One of the pair of folding rollers 41 is a driving roller 41A. The other of the pair of folding rollers 41 is a driven roller 41B.

The driving roller 41A is rotationally driven at a fixed position without moving. The driving roller 41A is rotationally driven by a drive source. For example, the drive source of the driving roller 41A is a DC motor. The drive source transmits driving force to the driving roller 41A. For example, the drive source of the driving roller 41A also transmits the driving force to the blade 43. "41*a*" is a rotational shaft of the driving roller 41A.

The driven roller 41B can approach and separate from the driving roller 41A such that a distance therebetween is variable or adjustable (e.g., based on the number of sheets S in the sheet bundle S'). The driven roller 41B is urged toward the driving roller 41A by an urging mechanism (e.g., a biasing element, a spring, etc.). The driven roller 41B rotates by following the rotation of the driving roller 41A. "41*b*" is a rotational shaft of the driven roller 41B.

The sheet bundle S' is pinched in the nip portion 42 of the folding rollers 41 by the blade 43. The folding rollers 41 folds the sheet bundle S' inserted into the nip portion 42 in half, and sends out the folded sheet bundle S' to the downstream side. The "feeding direction" is the direction in which the folding rollers 41 feeds out the sheet bundle S'.

Figure 4:
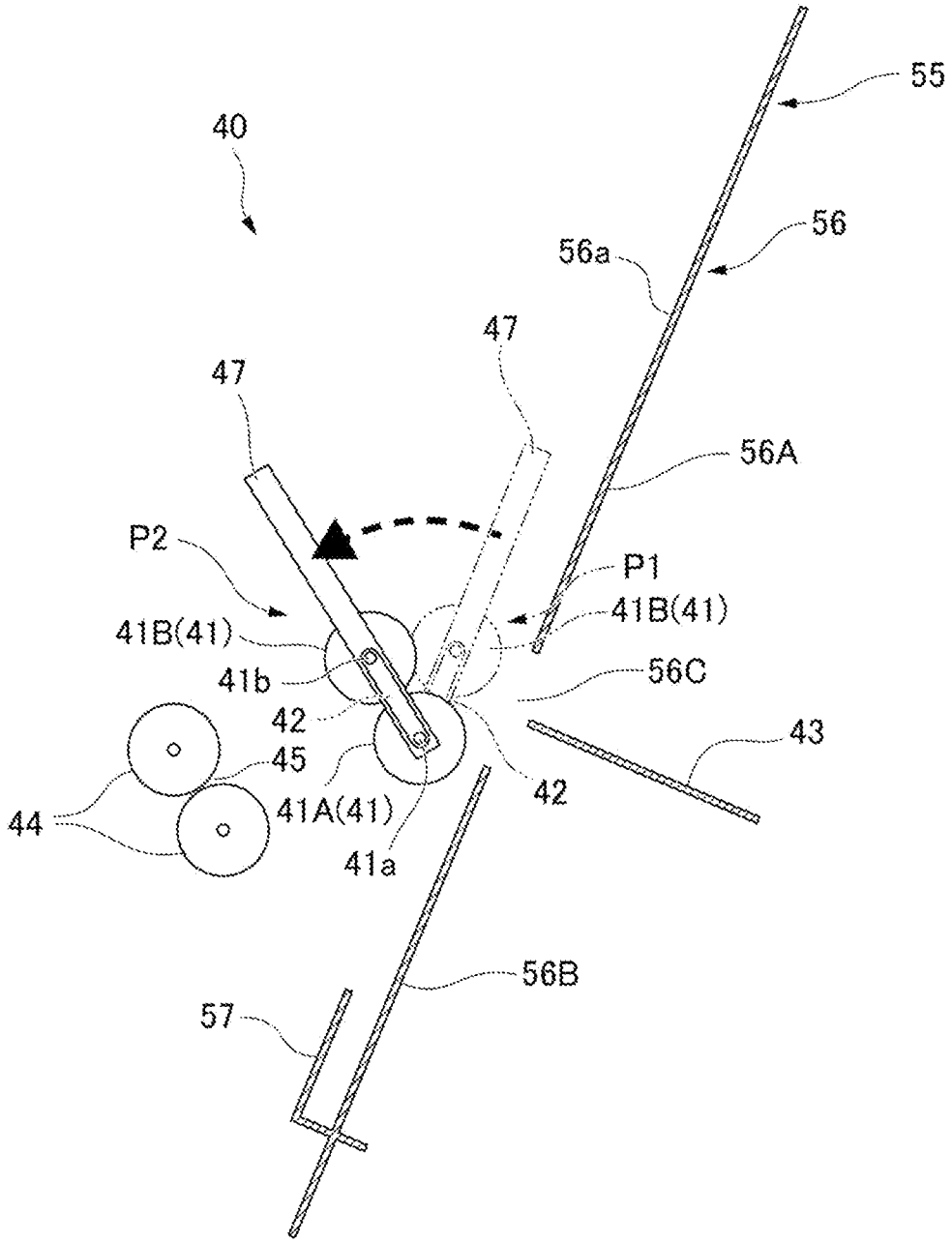
FIG. 4 is an explanatory diagram illustrating an operation of the folding mechanism.

As illustrated in FIG. 4, the driven roller 41B can be displaced by rotating around a rotational shaft 41*a* of the driving roller 41A. The driving roller 41A and the driven roller 41B can switch or pivot or reposition between a first position or orientation, shown as first posture P1, and a second position or orientation, shown as second posture P2, by the drive source (drive motor). The first posture P1 is a posture in which the driving roller 41A and the driven roller 41B are aligned in parallel with the stacking surface 56*a*. In the first posture P1, the driving roller 41A and the driven roller 41B have the same distance from the stacking surface 56*a*. In the first posture P1, the feeding direction of the sheet bundle S' is slightly upward (obliquely upward) with respect to the horizontal direction. The folding rollers 41 in the first posture P1 can receive the sheet bundle S' from the stacker 55.

The second posture P2 is the posture of the folding rollers 41 located at a position where the driven roller 41B is displaced in the direction or pivoted around the axis of the rotational shaft 41*a*. In the second posture P2, the driven roller 41B has a larger distance from the stacking surface 56*a* than that of the driving roller 41A. In the second posture P2, the feeding direction of the sheet bundle S' is different from that in the first posture P1. The feeding direction of the sheet bundle S' in the second posture P2 is a horizontal direction or is directed downward (obliquely downward) from the horizontal direction. The alignment direction of the folding rollers 41 in the second posture P2 is parallel to the alignment direction of the discharge rollers 44. The nip portion 42 of the folding rollers 41 in the second posture P2 is positioned so as to face a nip portion 45 of the discharge rollers 44.

The lever 47 connects the driving roller 41A and the driven roller 41B. Since the driven roller 41B can be displaced by inclining the lever 47, the first posture P1 and the second posture P2 of the folding rollers 41 can be switched.

The blade 43 is a plate-shaped member. The blade 43 is located at a position facing the nip portion 42 of the folding rollers 41 in the first posture P1. In the embodiment, the blade 43 has a length in a direction orthogonal to the stacking surface 56*a* of the guide member 56. Since the stacking surface 56*a* is inclined with respect to the vertical direction, the blade 43 is inclined with respect to the horizontal direction. For example, the blade 43 is metal such as stainless steel.

The blade 43 can reciprocate so as to insert and remove a tip edge thereof into and from the nip portion 42 of the folding rollers 41. For example, the blade 43 reciprocates via a slider crank mechanism. The blade 43 enters the nip portion 42 while pushing a central portion of the sheet bundle S' into the nip portion 42. The blade 43 retracts from the nip portion 42 while leaving the sheet bundle S' in the nip portion 42 (see FIG. 6).

The pair of discharge rollers 44 are located on the downstream side of the folding rollers 41 in the conveyance direction. The pair of discharge rollers 44 form the nip portion 45. One of the pair of discharge rollers 44 is a driving roller. The other of the pair of discharge rollers 44 is a driven roller. The driving roller is rotationally driven at a fixed position without moving. The driven roller can approach to and separate from the driving roller. The driven roller is urged toward the driving roller by an urging mechanism (e.g., a biasing element, a spring, etc.). The sheet bundle S' (folded body) conveyed by the folding rollers 41 is pinched in the nip portion 45 of the discharge rollers 44. The discharge rollers 44 convey the folded body inserted into the nip portion 45. The feeding direction of the folded body by the discharge rollers 44 is the horizontal direction or obliquely downward. The feeding direction of the folded body by the discharge rollers 44 is the same as the feeding direction of the sheet bundle S' in the second posture P2 of the folding rollers 41. The folding rollers 41 and the discharge rollers 44 may be rotationally driven independently of each other by a drive source, or may be rotationally driven in synchronization with each other.

As illustrated in FIG. 3, the sheet discharge tray 46 is located on the downstream side of the discharge rollers 44 in the conveyance direction. The folded body sent from the discharge rollers 44 is stacked on the sheet discharge tray 46. When the sheet discharge tray 46 is located at a position where the folded body sent from the discharge rollers 44 is directly discharged, a disturbance of stacking posture of the folded body can be suppressed, and thus stackability of the folded body is improved.

A staple unit may be present above the stacker 55. The staple unit performs stapling on the sheet bundle S' before being sent to the folding mechanism 40.

As illustrated in FIG. 1, a gate 20*a* is present on the downstream side of the carry-in portion 20 of the post-processing apparatus 3. The gate 20*a* switches a conveyance destination of the sheet S to either the processing unit 22 or the folding mechanism 40. The gate 20*a* conveys the sheet S to the standby unit 21 when sheet folding is not performed. The gate 20*a* conveys the sheet S to the folding mechanism 40 when sheet folding is performed.

Next, the operation of the folding mechanism 40 will be described. As illustrated in FIG. 1, the sheet S sent from the image forming apparatus 2 is supplied via a sheet path 54. The staple unit may perform stapling on the sheet bundle S' composed of the plurality of sheets S.

Figure 5:
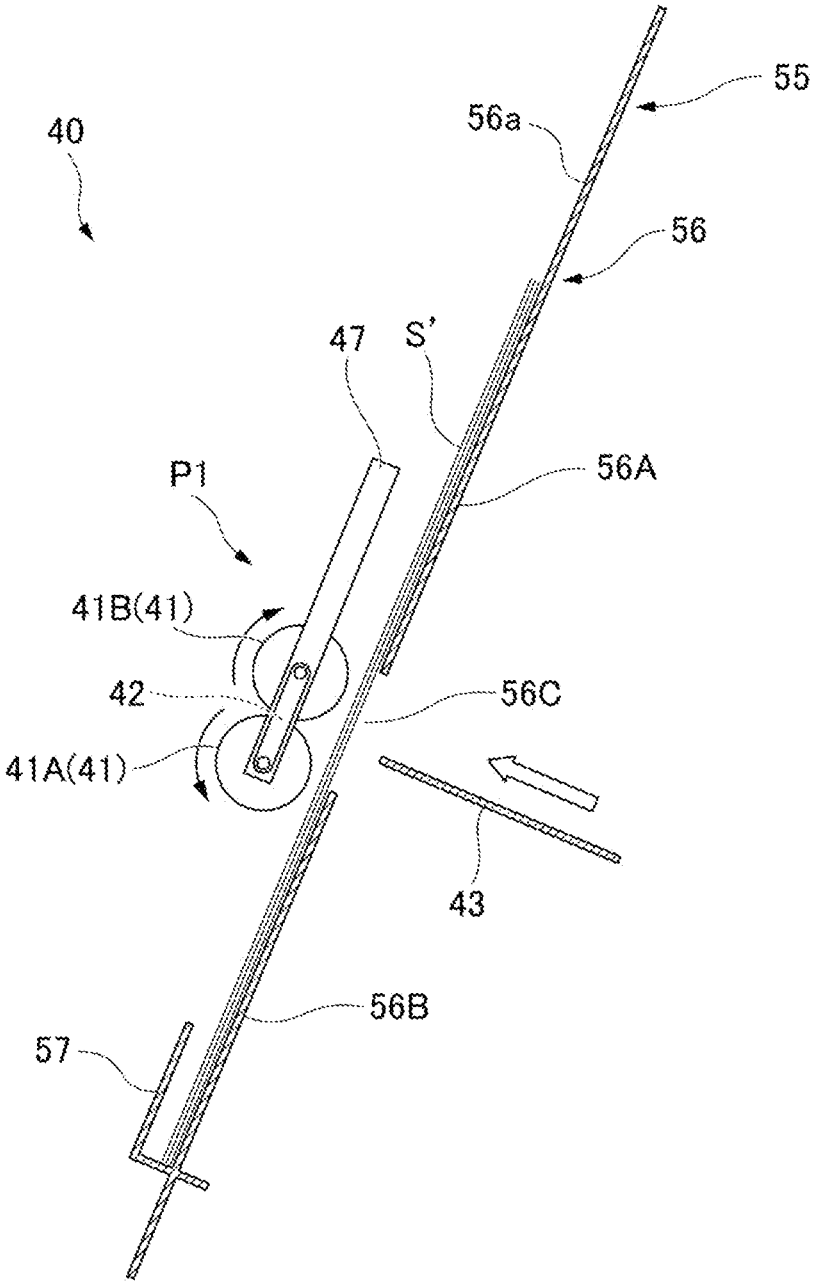
FIG. 5 is another explanatory diagram illustrating the operation of the folding mechanism.

As illustrated in FIG. 5, the sheet bundle S' supplied to the folding mechanism 40 is stacked on the stacking surface 56*a* of the stacker 55. The center portion of the sheet bundle S' (center position in the sheet conveyance direction) faces the nip portion 42 of the folding rollers 41. The folding rollers 41 is in the first posture P1.

Figure 6:
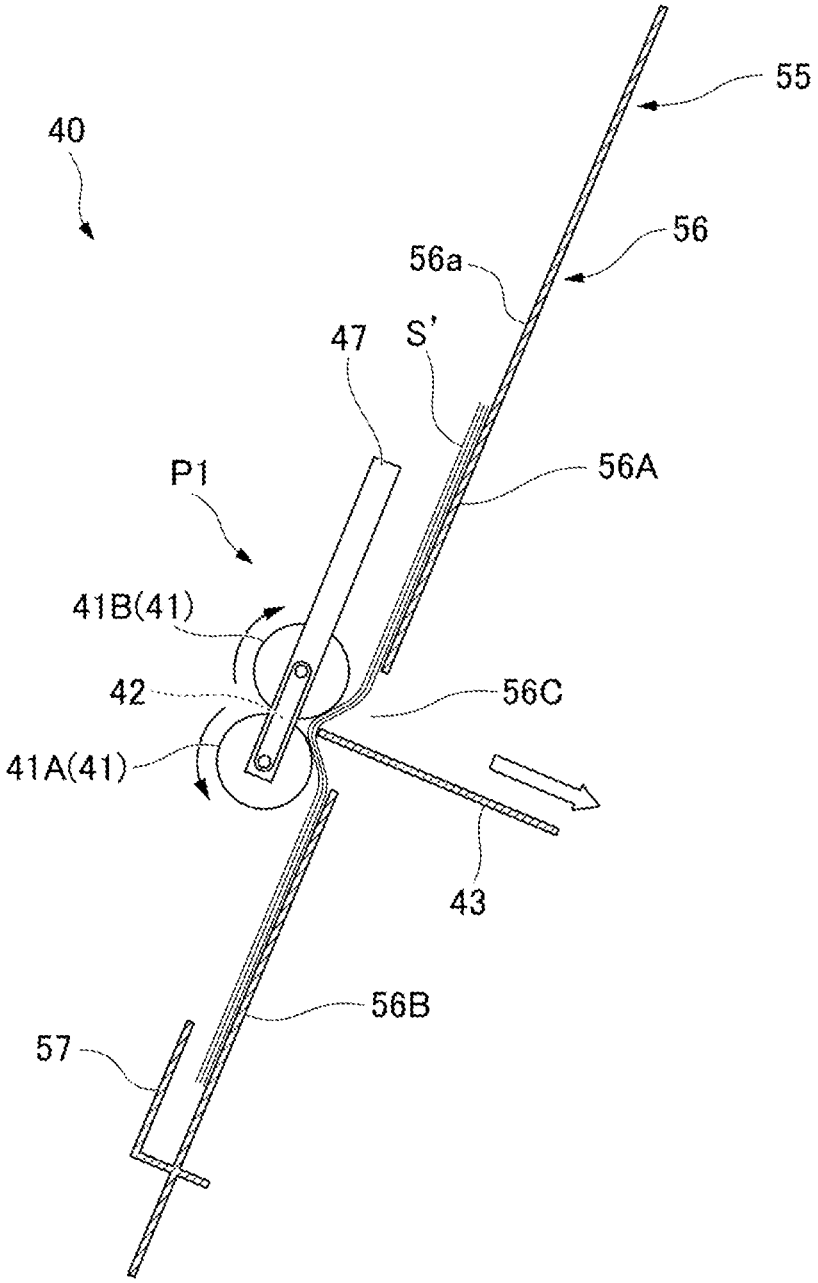
FIG. 6 is another explanatory diagram illustrating the operation of the folding mechanism.

The blade 43 pushes out the central portion of the sheet bundle S' toward the nip portion 42 of the folding rollers 41. As illustrated in FIG. 6, the blade 43 pushes the central position of the sheet bundle S 'into the nip portion 42. After pushing the sheet bundle S' into the nip portion 42, the blade 43 retracts.

Figure 7:
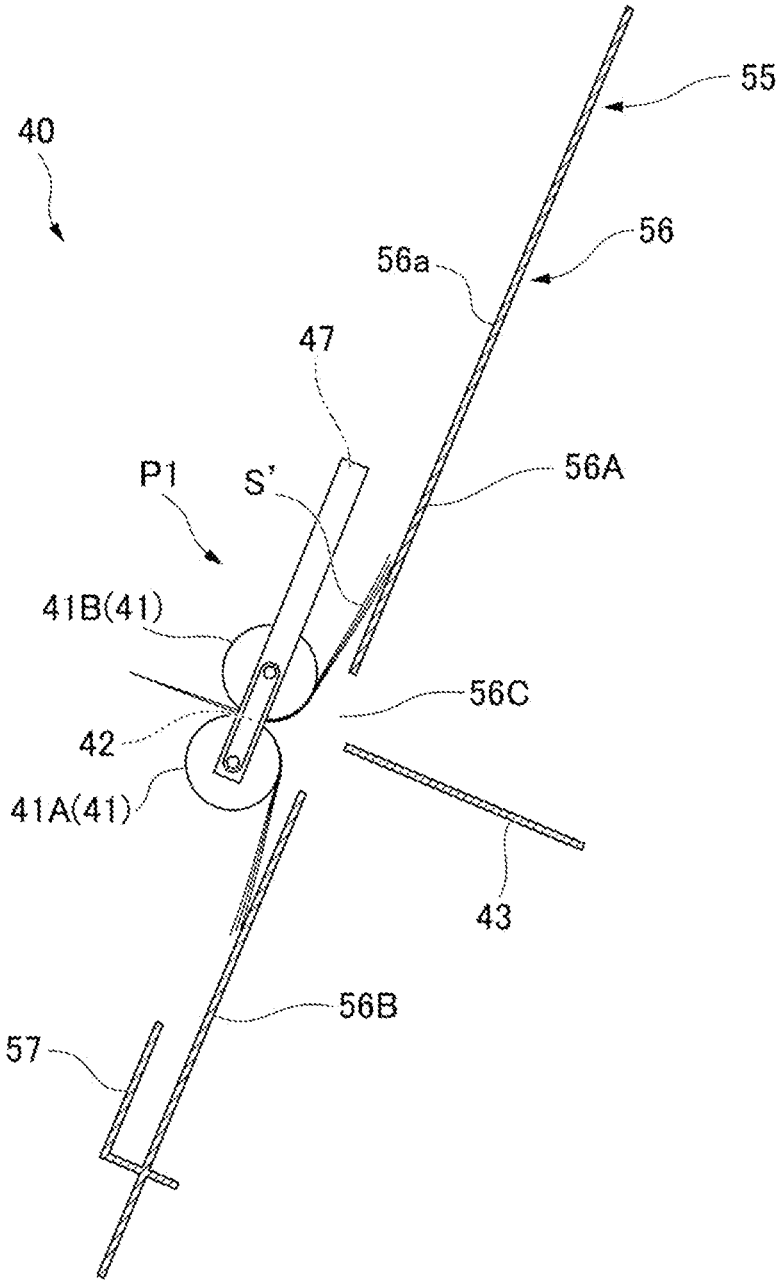
FIG. 7 is another explanatory diagram illustrating the operation of the folding mechanism.

As illustrated in FIG. 7, the folding rollers 41 rotates while pinching the sheet bundle S' therebetween, and folds the sheet bundle S' in half. Since the feeding direction of the folding rollers 41 in the first posture P1 is obliquely upward, the sheet bundle S' folded in half is sent out obliquely upward. The conveyance of the sheet bundle S' is temporarily stopped with the folding rollers 41 pinching the sheet bundle S'.

Figure 8:
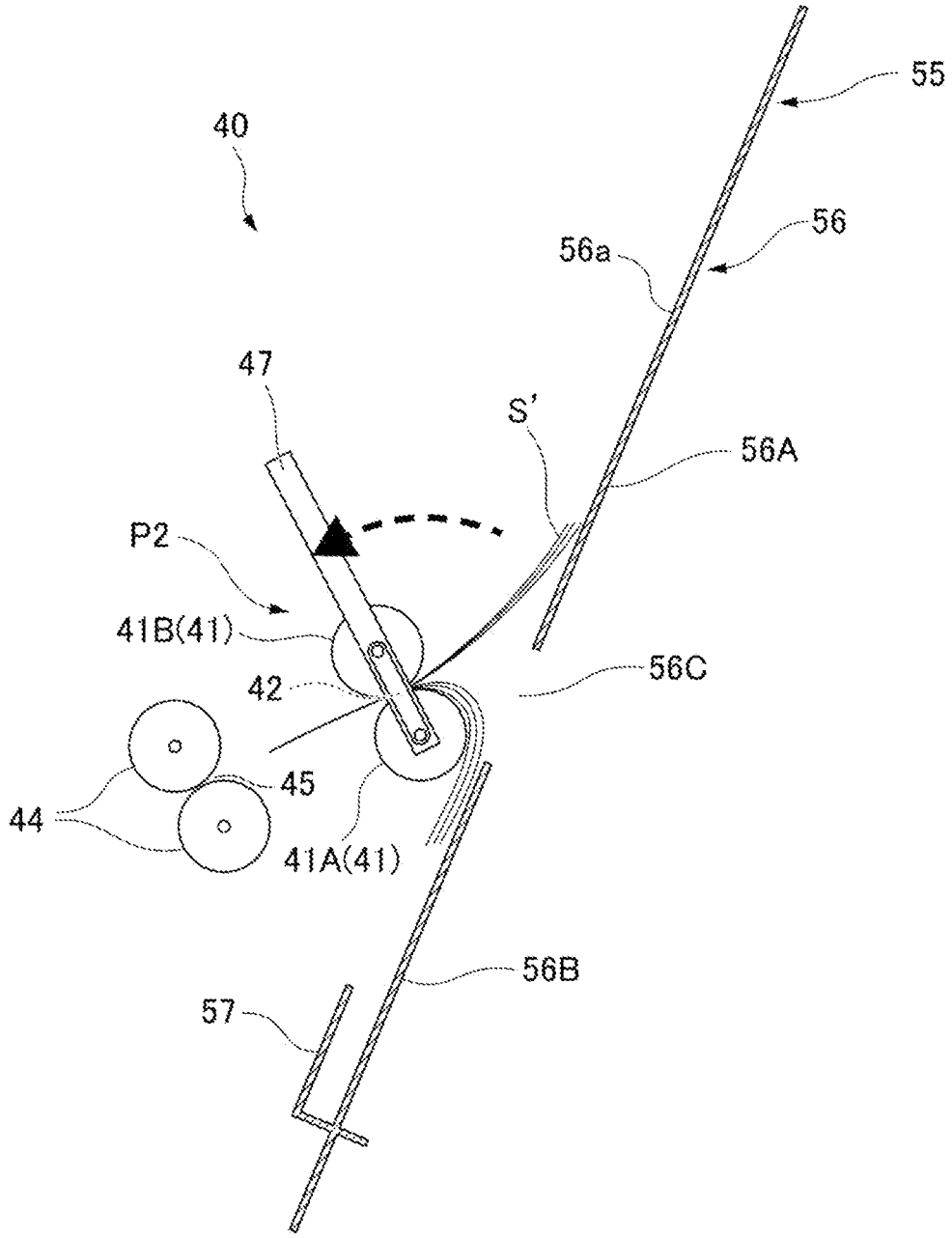
FIG. 8 is another explanatory diagram illustrating the operation of the folding mechanism.

As illustrated in FIG. 8, the posture of the folding rollers 41 is pivoted, repositioned, or switched from the first posture P1 to the second posture P2 with the folding rollers 41 pinching the sheet bundle S'. Since the feeding direction of the folding rollers 41 in the second posture P2 is horizontal or obliquely downward, the sheet bundle S' of the portion folded in half is also horizontal or obliquely downward.

Figure 9:
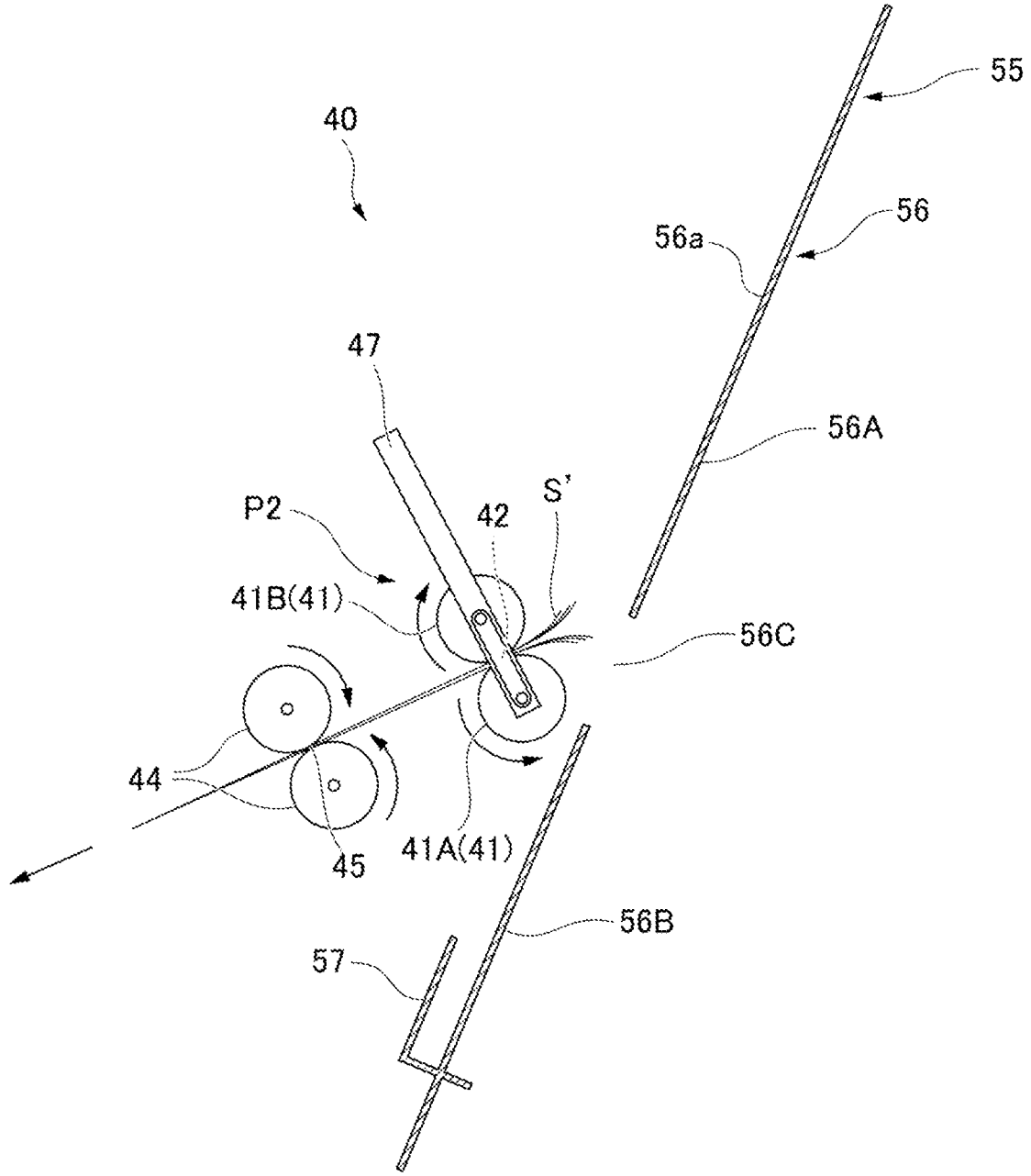
FIG. 9 is another explanatory diagram illustrating the operation of the folding mechanism.

As illustrated in FIG. 9, rotational drive of the folding rollers 41 is restarted. The sheet bundle S' folded in half is fed into the nip portion 45 of the discharge rollers 44 and conveyed by the discharge rollers 44. The sheet bundle S' folded in half is a "folded body". The discharge rollers 44 conveys the folded body in the horizontal direction or obliquely downward. The folded body is discharged to the sheet discharge tray 46 (see FIG. 1 and FIG. 3). At the point in time when the sheet bundle S' is separated from the folding rollers 41, the folding rollers 41 are returned from the second posture P2 to the first posture P1 (see FIG. 5).

In the post-processing apparatus 3 of this embodiment, the folding rollers 41 can switch between the first posture P1 and the second posture P2. In the post-processing apparatus 3, the direction of the sheet bundle S' can be changed to be horizontal or obliquely downward by setting the folding roller 41 to the second posture P2 after the folding roller 41 receives the sheet bundle S' in the first posture P1. Since the post-processing apparatus 3 can discharge the folded sheet bundle S' (folded body) to the sheet discharge tray 46 in a horizontal or obliquely downward posture, the disturbance of stacking posture of the folded body on the sheet discharge tray 46 can be suppressed. The post-processing apparatus 3 is excellent in terms of stackability of the folded body because the stacking posture of the folded body on the sheet discharge tray 46 is good.

In the post-processing apparatus 3, since the direction of the sheet bundle S' is changed by the folding rollers 41, the apparatus configuration can be simplified as compared with when a dedicated conveyance roller for changing the direction of the sheet is provided. The post-processing apparatus 3 can be miniaturized. In the post-processing apparatus 3, since the direction of the sheet bundle S' is changed by the folding rollers 41, application of large frictional force to the sheet bundle S' can be suppressed and the damage received by the sheet bundle S' can be reduced, unlike when the sheet is brought into abutment on the abutting structure in the apparatus to change the direction.

The folding rollers 41 can switch between the first posture P1 and the second posture P2 by rotating around the rotational shaft 41*a* of the driving roller 41A. Since the rotational shaft 41*a* of the driving roller 41A is used, a mechanism for rotating the folding rollers 41 can be simplified.

Since the alignment direction of the folding rollers 41 in the first posture P1 is parallel to the stacking surface 56*a*, the sheet bundle S' can be smoothly guided to the nip portion 42 by the blade 43. Since the alignment direction of the folding rollers 41 in the second posture P2 is parallel to the alignment direction of the discharge rollers 44, the sheet bundle S' can be smoothly guided to the discharge rollers 44. Since the nip portion 42 of the folding rollers 41 in the second posture P2 is positioned so as to face the nip portion 45 of the discharge rollers 44, the sheet bundle S' can be smoothly guided to the nip portion 45 of the discharge rollers 44.

In the embodiment, the folding rollers 41 can switch between the first posture P1 and the second posture P2 by rotating around the rotational shaft 41*a* of the driving roller 41A, but the center of rotation for switching between the first posture P1 and the second posture P2 is not limited to the rotational shaft of the driving roller. For example, the center of rotation may be the nip portion of the folding rollers. The post-processing apparatus 3 of the embodiment includes the discharge rollers 44, but the post-processing apparatus may not include a discharge roller.

In the post-processing apparatus 3 of the embodiment, a protruding length of the sheet bundle S' sent out by the folding rollers 41 may be detected by an optical sensor or the like (see FIG. 7). The post-processing control unit 24 can control the operation of the folding rollers 41 and switch the folding rollers 41 from the first posture P1 to the second posture P2 (see FIG. 2 and FIG. 8) based on a detected value from the optical sensor.

According to at least one embodiment described above, since the folding roller 41 can discharge the sheet bundle S' (folded body) to the discharge tray 46 in a horizontal or obliquely downward posture by switching between the first posture P1 and the second posture P2, the stackability of the folded body on the paper tray 46 is excellent. In the post-processing apparatus 3, since the device configuration can be simplified, miniaturization of the apparatus can be achieved. In the post-processing apparatus 3, the damage received by the folded body can be reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet post-processing apparatus comprising:

a stacker on which a sheet is stacked;

a pair of folding rollers having a nip portion therebetween; and a blade configured to fold the sheet in half by pushing the sheet stacked on the stacker into the nip portion of the pair of folding rollers;

wherein the pair of folding rollers are configured to switch between a first posture in which the sheet is pushed into the nip portion by the blade and a second posture in which a feeding direction of the sheet is different from that in the first posture.

2. The sheet post-processing apparatus of claim 1, wherein the pair of folding rollers are repositionable between the first posture and the second posture by rotating about a rotational shaft of one of the pair of folding rollers.

3. The sheet post-processing apparatus of claim 1, wherein the stacker includes a stacking surface on which the sheet is stacked, and an alignment direction of the pair of folding rollers in the first posture is parallel to the stacking surface.

4. The sheet post-processing apparatus of claim 3, further comprising a pair of discharge rollers configured to receive the sheet from the pair of folding rollers when the pair of folding rollers are in the second posture.

5. The sheet post-processing apparatus of claim 4, wherein the alignment direction of the pair of folding rollers in the second posture is parallel to an alignment direction of the pair of discharge rollers.

6. The sheet post-processing apparatus of claim 4, wherein the nip portion of the pair of folding rollers in the second posture faces a nip portion of the pair of discharge rollers.

7. The sheet post-processing apparatus of claim 4, wherein a sheet discharge tray on which the sheet sent from the pair of discharge rollers is stacked is on a downstream side of the pair of discharge rollers.

8. The sheet post-processing apparatus of claim 7, wherein the sheet discharge tray is located at a position where the sheet sent from the pair of discharge rollers is directly discharged.

9. The sheet post-processing apparatus of claim 1, wherein the stacker includes an obliquely upward-facing stacking surface on which the sheet is stacked, and the feeding direction of the sheet of the pair of folding rollers in the first posture is obliquely upward.

10. The sheet post-processing apparatus of claim 7, wherein the feeding direction of the sheet of the pair of folding rollers in the second posture is obliquely downward.

11. A sheet post-processing apparatus comprising:

a guide plate having a first portion, a second portion, and a gap between the first portion and the second portion; and a support positioned along the second portion, wherein the guide plate is positioned to guide a sheet to the support, and wherein the support is positioned to align a center portion of the sheet with the gap;

a folding lever positioned adjacent the gap, the folding lever having a first pair of rollers coupled thereto, the folding lever pivotable between a first position where the folding lever is parallel with the guide plate and a second position where the folding lever is not parallel with the guide plate;

a plunger positioned to selectively extend through the gap of the guide plate to push the center portion of the sheet between the first pair of rollers to fold the sheet into a folded sheet; and a second pair of rollers positioned downstream of the first pair of rollers, wherein the second pair of rollers receive the folded sheet from the first pair of rollers when the lever is pivoted into the second position.

12. The sheet post-processing apparatus of claim 11, wherein the support is repositionable along the second portion of the guide plate.

13. The sheet post-processing apparatus of claim 11, wherein a first roller of the first pair of rollers is repositionable along the lever such that a distance between the first pair of rollers is variable.

14. The sheet post-processing apparatus of claim 13, wherein the first roller is biased toward a second roller of the first pair of rollers.

15. The sheet post-processing apparatus of claim 13, wherein the first pair of rollers can receive a sheet bundle including a plurality of sheets.

16. The sheet post-processing apparatus of claim 15, further comprising a stapling mechanism configured to staple the sheet bundle prior to the sheet bundle being provided to the guide plate.

17. The sheet post-processing apparatus of claim 11, wherein a tray positioned to receive the folded sheet from the second pair of rollers, and wherein a plurality of folded sheets can be stacked on top of each other within the tray.

18. The sheet post-processing apparatus of claim 11, wherein the guide plate is oriented at an angle relative to a horizontal such that a support surface of the guide plate faces obliquely upward.

19. The sheet post-processing apparatus of claim 18, wherein the first pair of rollers provide the folded sheet to the second pair of rollers in an obliquely downward direction when the folding lever is in the second position.

20. The sheet post-processing apparatus of claim 18, wherein the first pair of rollers provide the folded sheet to the second pair of rollers along the horizontal when the folding lever is in the second position.

* * * * *